US005120035A

United States Patent [19]

Neuenschwander et al.

[11] Patent Number: 5,120,035

[45] **Date of Patent: * Jun. 9, 1992**

[54] WORK BENCH

[75] Inventors: Charles H. Neuenschwander; William P. Hopkins; David A. Petersen, all of Austin, Tex.

[73] Assignee: Tekton Innovations, Inc., Austin, Tex.

[ * ] Notice: The portion of the term of this patent subsequent to Mar. 20, 2007 has been disclaimed.

[21] Appl. No.: 467,867

[22] Filed: Jan. 22, 1990

Related U.S. Application Data

[62] Division of Ser. No. 237,770, Aug. 29, 1988, Pat. No. 4,909,495.

[51] Int. Cl.[5] ..... B25B 1/16

[52] U.S. Cl. ..... 269/158

[58] Field of Search ..... 269/157-159, 269/91-94

[56] References Cited

U.S. PATENT DOCUMENTS

| | | |
|---|---|---|
| 663,819 | 12/1900 | Newnam . |
| 1,114,992 | 10/1914 | Kalaher . |
| 1,253,725 | 1/1918 | Rahfeldt . |
| 1,418,924 | 6/1922 | Hodgkinson . |
| 1,764,242 | 6/1930 | Brown . |
| 1,818,837 | 8/1931 | Barker . |
| 3,025,050 | 3/1962 | George et al. . |
| 3,099,875 | 0/1963 | Lelis . |
| 3,223,072 | 12/1965 | Bross . |
| 3,318,289 | 5/1967 | Marynissen . |
| 3,608,885 | 9/1971 | Roth . |
| 4,699,363 | 10/1987 | Semmler . |

FOREIGN PATENT DOCUMENTS

| | | |
|---|---|---|
| 295589 | 12/1916 | Fed. Rep. of Germany . |
| 929271 | 6/1955 | Fed. Rep. of Germany . |
| 1932856 | 1/1971 | Fed. Rep. of Germany . |
| 8118370 | 10/1981 | Fed. Rep. of Germany . |
| 3150665 | 6/1983 | Fed. Rep. of Germany . |
| 53356 | 10/1945 | France . |
| 1358869 | 3/1964 | France . |
| 155841 | 9/1932 | Switzerland . |
| 579207 | 7/1946 | United Kingdom . |
| 2150880 | 7/1985 | United Kingdom . |

OTHER PUBLICATIONS

PCT International Search Report (International Application No. PCT/US89/03692).

*Primary Examiner*—Robert C. Watson
*Attorney, Agent, or Firm*—Arnold, White & Durkee

[57] ABSTRACT

A workbench capable of clamping workpieces of various thicknesses. The workbench includes a laterally disposed work table mounted on a support structure. A clamping member is provided which includes a clamp positioned above the work table and configured to clamp a workpiece between the clamp and the work table. The workbench further includes a foot treadle pivotally mounted on the support structure. A linkage interconnects the foot treadle wit the clamping member such that rotation of the foot treadle in a first direction moves the clamp into clamping relation with the work table, and rotation of the foot treadle in a second direction moves the clamp away from the work table.

4 Claims, 4 Drawing Sheets

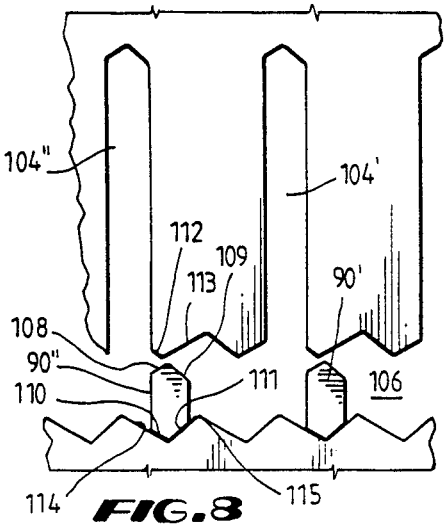
FIG.8
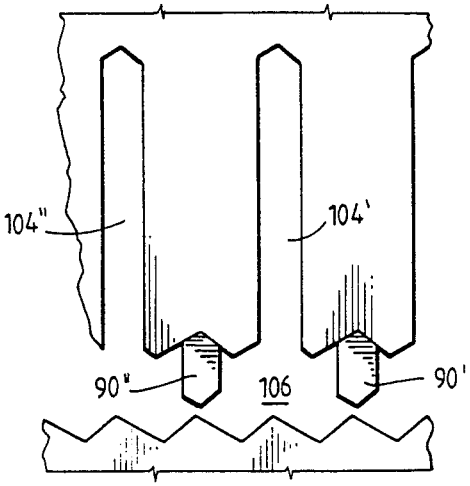
FIG.9
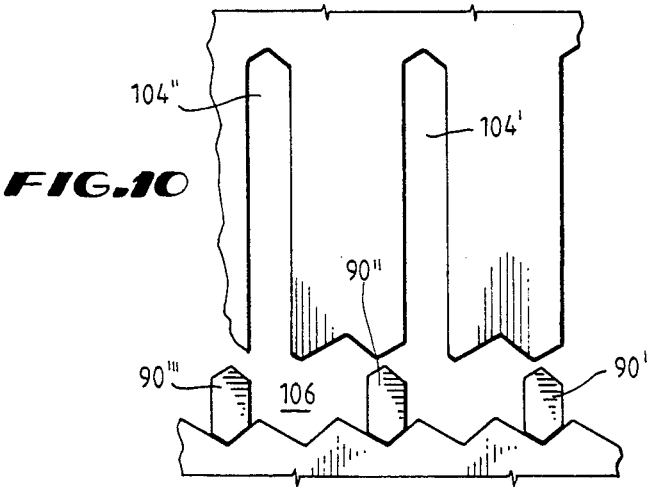
FIG.10
FIG.11
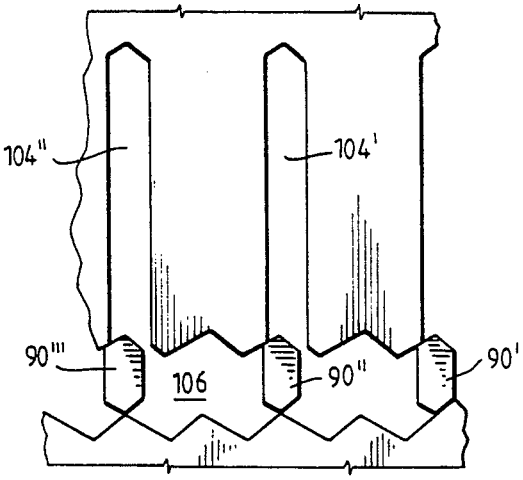
FIG.12
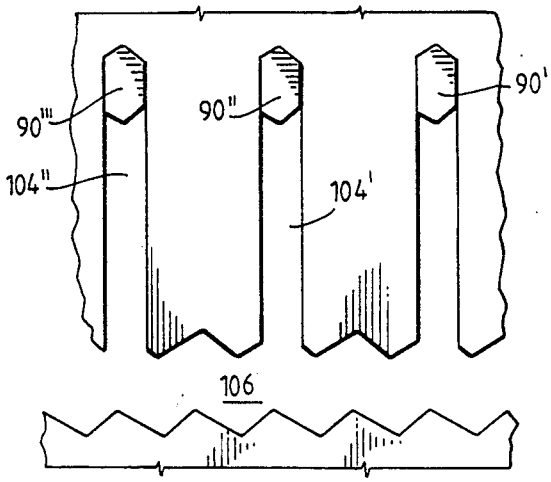

WORK BENCH

This is a divisional of application Ser. No. 237,770, filed Aug. 29, 1988 now U.S. Pat. No. 4,909,495.

BACKGROUND OF THE INVENTION

1. Field of the Invention

This invention relates to a workbench capable of clamping a workpiece, and more particularly to a foot operated workbench capable of clamping workpieces of various thicknesses in a generally horizontal position.

2. Description of the Related Art

Various workbenches have been developed which include clamping mechanisms for clamping items to be worked on, such as doors, boards, bicycles, etc. These workbenches generally include a hand operated clamp. The operator places the item to be worked on in the clamp and tightens the clamp by hand to grip the workpiece in a supported position. The clamping mechanisms of such workbenches generally hold the workpiece in a substantially vertical position. Additionally, while some of the clamping mechanisms can accommodate limited sizes of workpieces horizontally, it has been found that the mechanisms often fail to securely hold the workpieces when horizontally disposed.

Quite often, however, it is more convenient, and even necessary for the operator to have the workpiece disposed in a horizontal position above the ground. For example, if the operator desires to sand or saw a wide piece of lumber or other large workpiece, it would be easier to work on the material if it were positioned and clamped in a horizontal orientation. In the current methods known to the inventors, however, the worker typically places the material unclamped on a horizontal surface, such as across two conventional saw horses positioned next to each other. This arrangement causes a substantial disadvantage in that the workpiece is vulnerable to sliding or falling off the horizontal surface on which it is supported.

A further disadvantage experienced by many clamping workbenches lies in the provision of a hand operated clamping mechanism. With such mechanisms, the operator's hands are occupied to engage and disengage the clamp, and are not free to hold or position the workpiece. It is desirable for the worker to have his hands free to handle the workpiece during the clamping operation.

Accordingly, it is desirable to provide a clamping workbench which minimizes or eliminates the above disadvantages of many prior devices.

SUMMARY OF THE INVENTION

The present invention addresses the disadvantages of prior devices by providing a workbench which horizontally supports a workpiece and utilizes a foot-operated clamping mechanism for holding the workpiece horizontally.

In accordance with one aspect of the present invention, a workbench is provided which is capable of clamping workpieces of various thicknesses. The workbench includes a laterally disposed work table mounted on a support structure. The workbench also has a clamping member which includes a clamp positioned above the work table and configured to clamp such a workpiece between the clamp and the work table. The bench further includes a foot treadle pivotally mounted on the support structure, and a linkage interconnecting the foot treadle with the clamping member. Rotation of the foot treadle in a first direction moves the clamp into clamping relation with the work table, and rotation of the foot treadle in a second direction moves the clamp away from the work table. Means are preferably provided for locking the clamp in clamping relation with the work table.

In one embodiment of the present invention, the workbench also includes spring means for biasing the clamp away from the work table. In this embodiment, when the clamp is disengaged to release the workpiece, the biasing spring means moves the clamp upwards and away from the work table to totally release the workpiece, and to prepare the bench to receive another workpiece.

In another embodiment of the present invention, the linkage which interconnects the foot treadle with the clamping member includes a laterally disposed lever pivotally connected at a first position to the support structure and at a second position to the clamping member. The linkage also includes a connecting member pivotally connected at a first position to the foot treadle and at a second position to the laterally disposed lever. The point at which the connecting member is pivotally connected to the laterally disposed lever lies between the two pivot connections of the lever with the support structure and the clamping member. In this embodiment, when the foot treadle is rotated in the first direction, the connecting member is thereby pulled in a downward direction. This resultantly rotates the laterally disposed lever downward about the point at which it is pivotally connected to the support structure, thereby pulling the clamping member downward to engage the clamp with the workpiece.

In yet another preferred embodiment, the linkage includes spring means for providing increasing clamping force upon continued rotation of the foot treadle in the first direction after the clamp has engaged a workpiece being clamped. In this embodiment, the worker may place a workpiece on the work table so that a portion of the workpiece is disposed beneath the clamp. The worker rotates the foot treadle (e.g. by stepping down on it) in the first direction until the clamp comes into contact with the workpiece. The worker then continues to rotate the foot treadle in the first direction, which provides increasing clamping force on the workpiece. The worker may continue to rotate the foot treadle in the first direction until a sufficient force is exerted to securely clamp the workpiece. The bench then includes means for locking the spring means in such position so as to provide continued clamping force upon such a workpiece being clamped when the workers foot is removed from the treadle.

In the preferred embodiment of the present invention, the workbench includes a laterally disposed work table mounted on a support structure, and a clamping member positioned above the work table and configured to clamp a workpiece between the clamp and the work table. A foot treadle is pivotally mounted on the support structure. The workbench also includes a laterally disposed lever pivotally connected at a first position to the support structure and at a second position to the clamping member. The lever includes a bore. A connecting member is provided which is pivotally connected to the foot treadle and extends through the bore of the lever. A compression spring is disposed between the lever and the work table. The spring is connect a first end to the lever and at a second end to the connecting member such that downward motion of the connecting member compresses the compression spring when a workpiece is being clamped. Means are also provided for locking the compression spring in a compressed position.

It should be understood that when the term "connected" or "connection" is used, the connection can be a direct connection, or an indirect connection by means of intermediate parts. Thus, for example, the compression spring of this embodiment may be directly connected at its second end to the connecting member, or the spring may be connected to a spring cap, and the spring cap in turn connected directly or indirectly to the connecting member.

In a preferred aspect of this embodiment, the spring locking means includes a laterally disposed annular plate positioned above the second end of the compression spring. The plate has a bore through which the connecting member extends, and a plurality of fingers extending laterally at spaced distances around the circumference of the plate. Means are provided for retaining the annular plate in a freely disposed position above the second end of the spring. A cylindrical housing is provided in surrounding relationship with the compression spring. The housing has a hollow cavity through which the connecting member and compression spring extend. The housing includes a plurality of parallel longitudinal grooves along the internal periphery of the housing into which the fingers of the plate extend. The fingers and parallel longitudinal grooves are operable to restrict lateral rotational motion but allow axial motion of the plate. The housing also includes an annular groove along the internal periphery of the housing interconnecting the lower ends of the parallel longitudinal grooves. The annular groove is operable to receive the fingers of the plate from the lower ends of the parallel grooves when the spring is compressed, laterally rotate the fingers of the plate to an intermediate position laterally between the parallel grooves, and laterally rotate the fingers to the parallel grooves to release the spring.

In this embodiment, the foot treadle may be moved in the first direction so that the clamp engages a workpiece. After engagement, further rotation of the foot treadle in the first direction pulls the annular plate downwards and compresses the compression spring. The fingers of the plate are guided down the parallel grooves of the housing to the annular groove. When the fingers reach the annular groove, further downward rotation of the foot treadle rotates the plate laterally to a position such that release of the treadle advances the fingers of the plate to an intermediate position. The foot treadle is then released. This locks the compression spring in a compressed position, and the workpiece is effectively clamped.

To release the workpiece, the foot treadle is again rotated in the first direction, thereby laterally rotating the annular plate so that the fingers of the plate are rotated to an intermediate position. The foot treadle is then released to rotate in the second direction, such that the fingers and plate are rotated and are free to move axially up the parallel grooves to release the spring from its compressed position.

In a preferred aspect of this embodiment, means are provided for adjusting the position on the clamping member at which the laterally disposed lever is pivotally connected in order to be able to clamp a greater range of thicknesses of workpieces.

BRIEF DESCRIPTION OF THE DRAWINGS

This invention is now described by reference to the appended drawings which illustrate the preferred embodiments of the workbench.

FIGS. 6–12 are schematic views illustrating the spring locking mechanism of the workbench shown in FIG. 4.

DETAILED DESCRIPTION OF THE PREFERRED EMBODIMENTS

Figure 1:
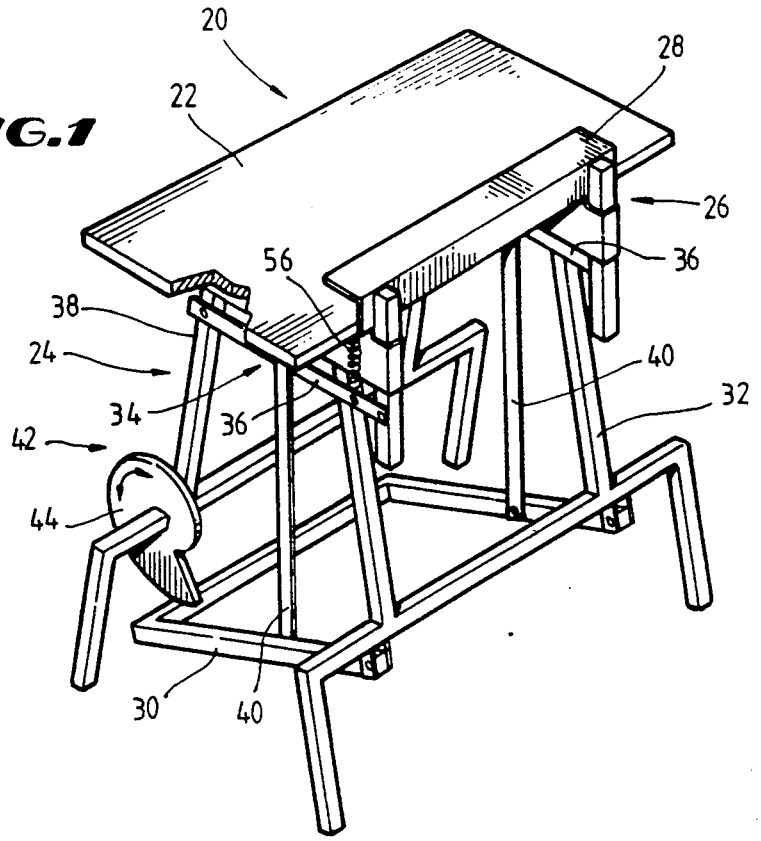
FIG. 1 is an isometric view of a workbench in accordance with one embodiment of the present invention.

FIG. 1 illustrates an embodiment of a workbench in accordance with the present invention, showing a workbench 20 which is capable of clamping workpieces of various thicknesses. The workbench 20 includes a laterally disposed work table 22 mounted on a support structure 24. A clamping member 26 is provided which includes a clamp 28 positioned above the work table 22 and configured to clamp a workpiece between the clamp 28 and the work table 22. As can be appreciated, a workpiece being clamped may thus be supported in a generally horizontal position on the work table 22.

A foot treadle 30 is pivotally mounted to a rear leg structure 32 of the support structure 24. A linkage 34 interconnects the foot treadle 30 with the clamping member 26. In this embodiment, the linkage includes a pair of laterally disposed levers 36, each being pivotally connected at a first position to a front leg structure 38 of the support structure 24. Each lever 36 is also pivotally connected at a second position to the clamping member 26. The linkage 34 further includes a pair of connecting members 40, each being pivotally connected at a first position to the foot treadle 30 and at a second position to the corresponding lever 36. In the preferred form of this embodiment, the point at which each connecting member 40 is connected to the corresponding lever 36 lies at a point between the pivot connections of the lever 36 with leg structure 38 and clamping member 26. It will be understood, however, that the lever 36 and point of pivotal attachment of the member 40 may be modified for different applications and still be within the spirit and scope of the invention.

The bench 20 further includes means for locking the clamp 28 in clamping relation with the work table 22 in the form of a down lock mechanism 42. The down lock mechanism 42 includes a rotary cam 44 which is pivotally mounted to the front leg structure 38. In operation, the treadle 30 is depressed to clamp an object between the work table 22 and the clamp 28. The treadle 30 is maintained in clamping position by rotating the rotary cam 44 clockwise as shown until the outer edge of the cam 44 engages the treadle 30. For this purpose, the outer edge of cam 44 is provided with a gripping surface to engage the foot treadle 30. To release the clamp 28, the rotary cam 44 is rotated in the opposite direction (counter clockwise as shown) while applying a downward force on the treadle, thus allowing the foot treadle 30 to rotate upwards, thereby raising clamp 28.

In the embodiment shown in FIG. 1, the clamp 28 is shown in a "clamped" position since the cam 44 is rotated essentially to its outermost position. As will be appreciated, a selected distance may be provided between the clamp bar 28 and the table 22 for the fully clamped position in order to accommodate the anticipated minimum thickness for a workpiece.

In a preferred aspect of this embodiment, the bench further includes a spring 56 or other bias means to bias clamp 28 in an upward direction away from table 22. For example, the spring 56 can be connected to one lever 36 proximate the point at which the lever 36 is pivotally connected to the clamping member 26. The other end of spring 56 may be connected to the bottom surface of the work table 22. As can be appreciated, the spring 56 thus biases the clamp 28 in an upward direction, so that the clamp 28 will release upwardly.

Figure 2:
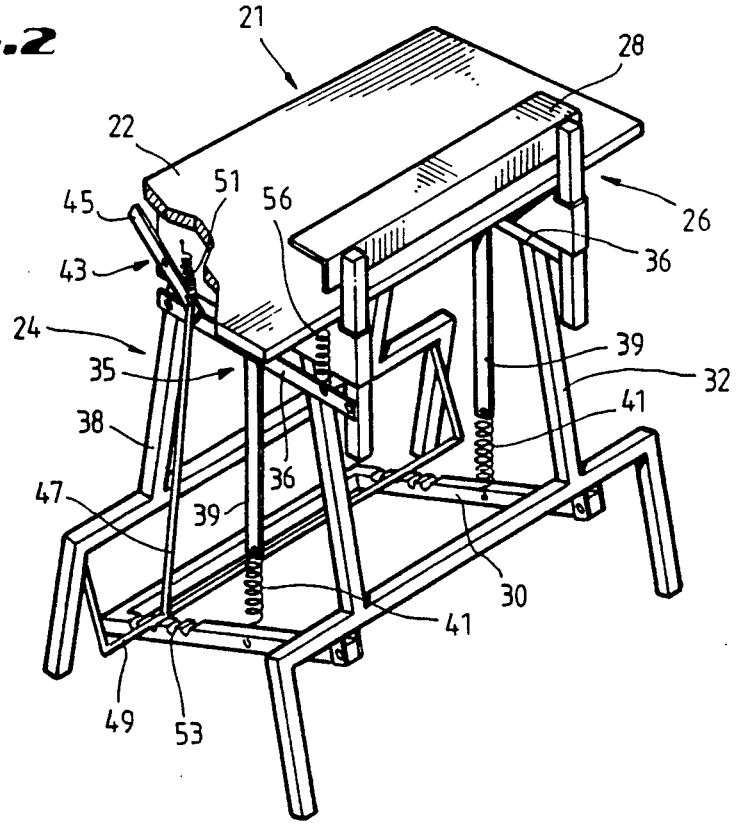
FIG. 2 is an isometric view of a workbench in accordance with another embodiment of the present invention.
Figure 3:
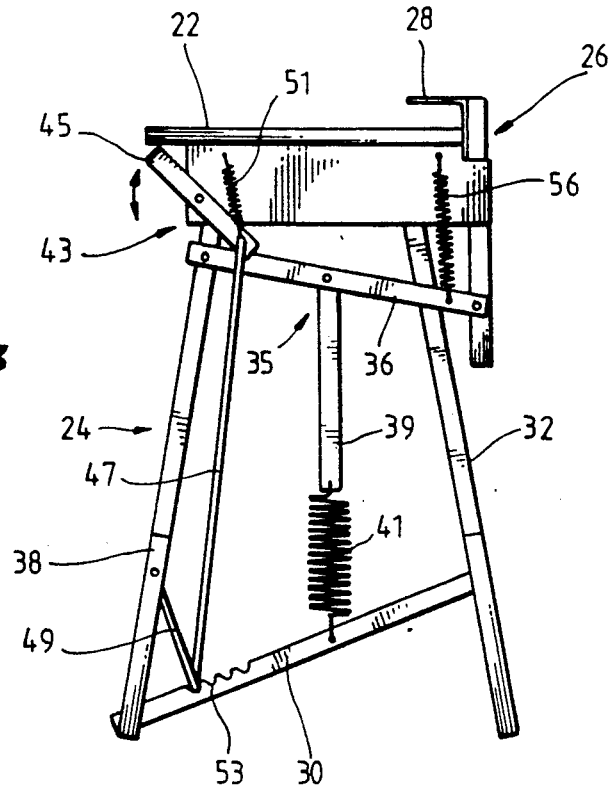
FIG. 3 is a side view of the workbench shown in FIG. 2.

FIGS. 2 and 3 illustrate a second embodiment of a workbench 21 in accordance with the present invention. Work bench 21 is similar to workbench 20 shown in FIG. I, differing in the linkage interconnecting clamp 28 and foot treadle 30. In this embodiment, a linkage 35 is provided including a pair of springs 41 and connecting members 39, interconnecting the levers 36 and the foot treadle 30. The connecting member 39 and spring 41 are located analogously to connecting member 40 shown in FIG. 1.

Referring particularly to FIG. 3, the operation of the workbench is now described. A workpiece to be clamped is placed in a generally horizontal position on the work table 22 so that at least a portion of the workpiece is positioned underneath the clamp 28. The operator rotates the foot treadle 30 in a downward position about the point at which the foot treadle 30 is pivotally connected to rear legs 32. This rotation causes downward movement of the connecting member 39 and spring 41, which in turn causes downward rotational movement of lever 36 about its pivot point on legs 38. This in turn causes downward motion of clamp member 26, thereby pulling clamp 28 into engagement with the workpiece.

After initial engagement of the clamp 28 with the workpiece, further downward movement of the connecting member 39 (as well as lever 36 and clamp 26) is generally prevented as further downward motion of the clamp 28 is blocked by the workpiece being clamped. Accordingly, further downward rotation of the treadle 30 after such engagement causes the spring 41 to stretch in tension and provide increasing clamping force commensurate with the resilient strength of the spring 41.

This embodiment further includes means to lock the spring 41 in a stretched, force-exerting position to securely clamp a workpiece. These means may include a down lock mechanism 43, which includes an actuating handle 45 pivotally connected to the support structure 24. The actuating handle 45 in turn is pivotally connected to a connecting bar 47 which is connected to a locking bar 49. The locking bar 49 is in turn pivotally connected to the support structure 24 to allow rotational downward movement of the locking bar 49 in use. The down lock mechanism 43 further includes a tension spring 51 which biases the actuating handle 45 to an open position. Foot treadle 30 includes a plurality of notches 53 for engaging the locking bar 49 at a desired position after sufficient clamping force has been achieved via the spring 41.

In operation, the actuating handle 45 is rotated in a clockwise direction (as shown in FIG. 3) which forces the locking bar 49 downwardly against the clamp treadle 30 to engage a notch 53 and lock the clamp treadle 30 in a desired position. To release the clamp, the operator rotates the foot treadle 30 to free the locking bar 49, thereby returning the down lock mechanism 43 to an open position due to the biasing force of the tension spring 51.

Figure 4:
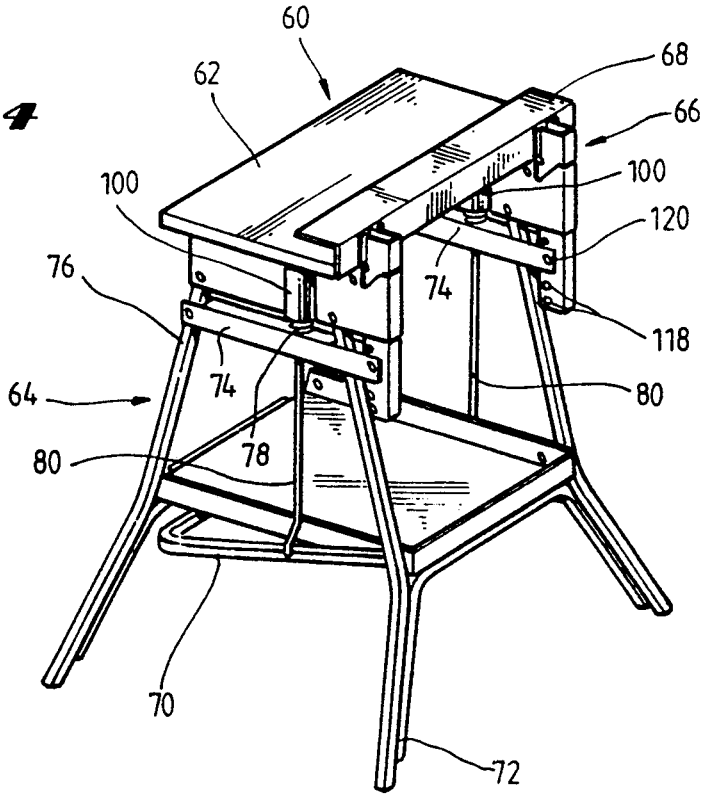
FIG. 4 is an isometric view of a workbench in accordance with the preferred embodiment of the present invention.

Referring now to FIGS. 4–12, the preferred embodiment of a workbench in accordance with the present invention is illustrated. Referring particularly to FIG. 4, a workbench 60 is shown, including a laterally disposed work table 62 mounted on a support structure 64. A clamping member 66 is provided including a clamp 68 positioned above the work table 62 and configured to clamp a workpiece between the clamp 68 and the work table 62. A foot treadle 70 is pivotally mounted to the support structure 64 proximate the rear legs 72 of the e 64. A pair of laterally disposed levers 74 are provided, each being pivotally connected at a first position to the front legs 76 of support structure 64, and at a second position to the clamping member 66. Each lever 74 has a bore 78. A connecting member 80 is pivotally connected to the foot treadle 70 and extends through the bore 78 of each lever 74.

Figure 5:
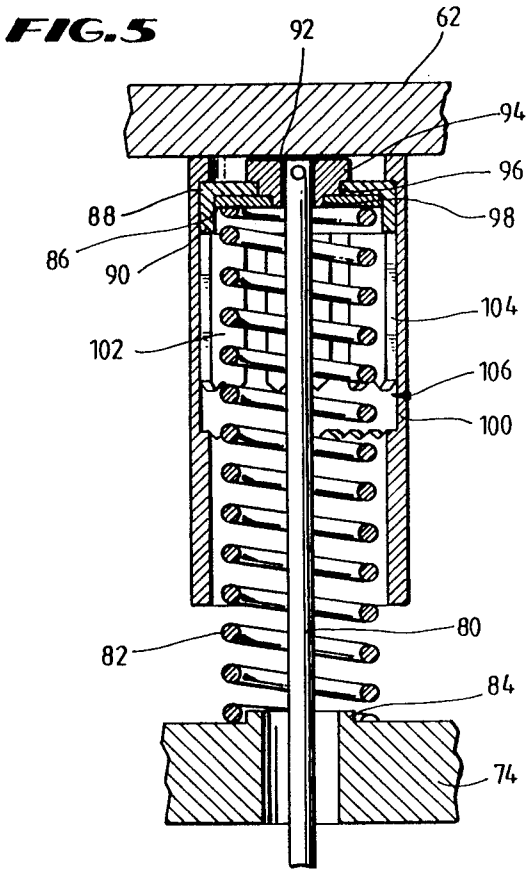
FIG. 5 is a sectional side view of the compression spring and locking means of the workbench shown in FIG. 4.

Referring now to FIG. 5, the workbench 60 of this embodiment also includes a compression spring 82 disposed between each lever 74 and the work table 62. The spring 82 is connected at a first end to the lever 74 at a spring mount 84. The spring 82 is indirectly connected at its second end to the connecting member 80 such that downward motion of the connecting member 80 compresses the spring 82 when a workpiece is being clamped.

Means for locking the spring 82 in a compressed position will now be described. The spring 82 is connected at its upper end to a spring cap 86. Located above spring cap 86 is a laterally disposed annular plate 88 which includes a plurality of fingers 90 extending laterally at spaced distances around the circumference of the plate 88.

The annular plate 88 is positioned above the second end of the spring 82 to provide for longitudinal movement of the plate 88 within a cylindrical housing 100 and rotational movement of the plate 88 within an annular groove 106 as will be described below. In the embodiment shown, the plate 88 is so positioned by means of a bushing 92 which allows the annular plate 88 to freely rotate relatively to the spring 82. The bushing 92, has three cylindrical sections 94, 96, and 98, and is attached to the connecting member 80. As shown, the spring cap 86 and the annular plate 88 each include an axial bore. The axial bore of the spring cap 86 has a slightly smaller diameter than the axial bore of the annular plate 88. The bushing 92 is cooperatively dimensioned with the axial bores of the spring cap 86 and plate 88 so that the third cylindrical section 98 of the bushing 92 is disposed within the axial bore of the spring cap 86, and the second cylindrical section 96 of the bushing 92 is disposed within the axial bore of the plate 88. The first cylindrical section 94 of the bushing 92 has a larger diameter than the axial bore of the annular plate 88. Similarly, the second cylindrical section 96 of the bushing 92 has a larger diameter than the axial bore of the spring cap 86.

Thus, as can be seen, the first cylindrical section 94 and the spring cap 86 retain the annular plate 88 in a freely and laterally disposed position above the second end of the spring 82. The bushing 92 may be connected to the connecting member 80 as shown in FIG. 4, or may be formed ar an integral part of the connecting member 80.

A cylindrical housing 100 is provided in fixed relationship with respect to the work table 62 and in surrounding relationship with compression spring 82. The housing 100 has a hollow cavity 102 into which the connecting member 80 and compression spring 82 extend. In the preferred embodiment, the housing includes a plurality of parallel longitudinal grooves 104 along the internal periphery of the housing 100 into which the fingers 90 of the plate 88 extend. As best shown in FIG. 5, the fingers 90 and parallel grooves 104 are operable to restrict lateral rotational motion but allow longitudinal motion of the plate 88. In other words, the plate 88 as shown in FIG. 5 can move vertically down the housing but cannot translate laterally when the fingers 90 are located in the parallel grooves 104. A selectively shaped annular groove 106 is also provided along the internal periphery of the housing 100. The annular groove 106 interconnects the lower ends of the parallel grooves 104. The annular groove 106 further comprises camming surfaces 112 through 115 which interact with camming surfaces 108 through 111 on the fingers 90 of the annular plate 88 to selectively rotate the annular plate 106 as will be described below.

Figure 6:
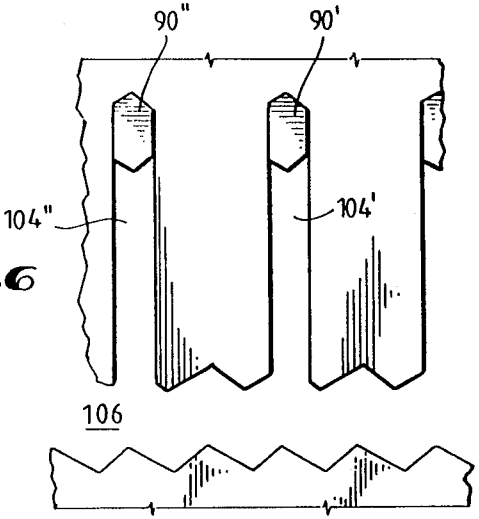

Referring now in particular to FIGS. 6–12, the operation of the spring locking mechanism provided by the present invention will be explained in detail. FIG. 6 shows the spring locking mechanism in its unlocked position. As shown, the fingers 90 are positioned at the upper ends of parallel grooves 104. (To track the path of each finger relative to each groove, fingers and grooves are differentiated in the figures with the use of prime symbols following the reference numerals). Referring back to FIG. 4, when the foot treadle 70 is rotated downwards, connecting member 80 pulls the spring 82 downward, thereby rotating the lever 74 downward. This in turn pulls the clamping member 66 downward until clamp 68 engages the workpiece being clamped. At this point, further rotation of the foot treadle 70 will compress the spring 82, thereby exerting increasing downward force on the clamp 68.

Figure 7:
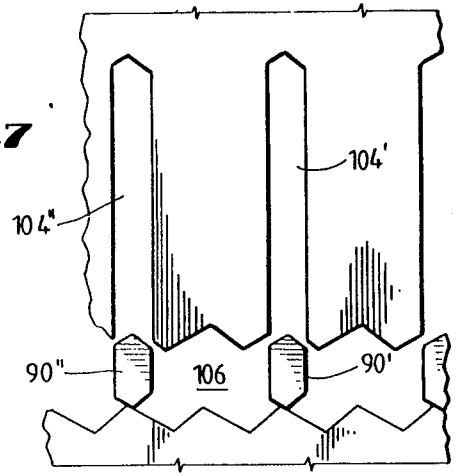

In order to lock the spring in a compressed position, and thereby lock the clamp 68 in a clamping position, the foot treadle 70 is rotated downward by the operator so that the fingers 90 of the annular plate 88 reach the position shown in FIG. 7. At this point, further downward rotation of the foot treadle 70 (causing further downward movement of the annular plate 88) causes the fingers 90 to laterally rotate in the annular groove 106 to the position shown in FIG. 8. By cooperatively dimensioning the camming surfaces 108, 109, 110, 111 of the fingers 90 and the camming surfaces 112, 113, 114, and 115 of the annular groove 106, the fingers 90 can now be laterally advanced to an intermediate locking position as shown in FIG. 9. When the fingers 90 reach the position shown in FIG. 8, the operator releases the foot treadle 70 wherein spring 82 causes it to rotate upwards. This causes lateral rotation of fingers 90 to the intermediate locking position in annular groove 106 shown in FIG. 9. The compression spring 82 provided should have such strength that at this locked position, the compression spring 82 exerts enough downward resilient force on the lever 74 to adequately clamp the workpiece between clamp 68 and work table 62.

To release the spring from the locked position, the worker again rotates the foot treadle downward, thereby advancing the fingers 90 o f the axial plate 88 to the position shown in FIG. 10. The operator then releases the foot treadle so that it rotates upward, thereby advancing the fingers 90 to the position shown in FIG. 11. From this position, the fingers 90 are returned to the parallel grooves 104, such that the fingers 90 slide up the grooves to the open position shown in FIG. 12. The clamp mechanism is thereby released.

Referring again to FIG. 4, means are preferably provided for adjusting the position of the clamping member 66 at which the lever 74 is pivotally connected. For example, a plurality of slots 118 may be provided in clamping member 66. A removable sliding pivot 120 may be provided so that the lever 74 can be pivotally connected to the clamping member 66 at the desired slot. Thus, pivot 12 can be removed from engagement with the clamping member 66 and reinstalled with the pivot hole in the lever 74 aligned with a different slot 118 in the clamping member 66. It should be appreciated that this adjustment allows the operator to conveniently clamp workpieces of different thicknesses over a much greater range.

The embodiment of FIG. 4 further includes a spring or bias means for biasing the clamp 68 in an upward direction away from the table 62. In the embodiment shown in FIG. 4, the bias means includes a spring which is encapsulated within the support member beneath the table 62 and is therefore not shown. The spring is essentially identical in placement and function to the spring 56 described above and shown in FIG. 1.

In each of the embodiments shown in the figures, the laterally disposed levers 36 and 74 are described as being pivotally connected to both the respective support structure and the respective clamping member. It will be appreciated by those of skill in the art that pivotal connections without play or slop would cause the movement of the clamping member to include an arcuate component with the vertical clamping motion. It is therefore desirable to provide play or slop in the pivotal connection between the laterally disposed lever and the clamping member to prevent binding of the clamping member when moving vertically.

The instant invention has been disclosed in connection with specific embodiments. However, it will be apparent to those skilled in the art that variations from the illustrated embodiments may be undertaken without departing from the spirit and scope of the invention.

What is claimed is:

1. A workbench capable of clamping a workpiece, comprising:

a laterally disposed work table mounted on a support structure;

a clamping member positioned above and movable relative to the work table and configured to clamp such a workpiece between the clamp and the work table;

a foot treadle pivotally mounted on the support structure;

a lever pivotally connected at a first position to the support structure and at a second position to the clamping member;

a connecting member pivotally connected to the foot treadle;

a compression spring disposed between the lever and the work table, the spring being connected at a first end to the lever and at a second end to the connecting member such that downward motion of the connecting member compresses the compression spring when such a workpiece is being clamped; and a locking mechanism which locks the compression spring in a compressed position.

2. The device of claim 1, wherein the locking mechanism comprises:

a cylindrical housing having an internal bore having an internal periphery, the housing further having along the internal periphery a plurality of parallel longitudinal grooves and a latitudinal annual groove intersecting the lower end of the longitudinal grooves, the bore being further sized and the cylindrical housing being positioned to receive the compression spring in use;

a laterally disposed annular plate rotatably connected to the connecting member at the second end of the compression spring, the plate including a plurality of fingers sized and positioned to mate into and longitudinally move along the longitudinal grooves of the cylindrical housing when the spring is positioned in the cylindrical housing; and the fingers and annular groove each having camming surfaces sized and positioned such that upon engagement of the respective camming surfaces, the annular plate is selectively rotated to an intermediate locked position and to a released position.

3. The workbench of claim 1, further comprising spring means for biasing the clamp away from the work table.

4. The device of claim 1, further comprising means for adjusting the position on the clamping member at which the lever is pivotally connected.

* * * * *

UNITED STATES PATENT AND TRADEMARK OFFICE

CERTIFICATE OF CORRECTION

PATENT NO. : 5,120,035

DATED : June 9, 1992

INVENTOR(S) : Charles H. Neuenschwander, et. al.

It is certified that error appears in the above-indentified patent and that said Letters Patent is hereby corrected as shown below:

Column 9, line 15, delete "annual" and insert therefor--annular--.

Signed and Sealed this

Twentieth Day of September, 1994

Bruce Lehman

*Attest:*

BRUCE LEHMAN

*Attesting Officer*

*Commissioner of Patents and Trademarks*